US011703790B2

(12) United States Patent
Maeda et al.

(10) Patent No.: US 11,703,790 B2
(45) Date of Patent: Jul. 18, 2023

(54) SUPPLY DEVICE AND IMAGE FORMING APPARATUS

(71) Applicant: FUJIFILM BUSINESS INNOVATION CORP., Tokyo (JP)

(72) Inventors: Shoichi Maeda, Kanagawa (JP); Teruki Naganuma, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 152 days.

(21) Appl. No.: 17/152,315

(22) Filed: Jan. 19, 2021

(65) Prior Publication Data

US 2022/0082977 A1 Mar. 17, 2022

(30) Foreign Application Priority Data

Sep. 11, 2020 (JP) ..... 2020-153092

(51) Int. Cl.
*B65H 3/14* (2006.01)
*G03G 15/00* (2006.01)

(52) U.S. Cl.
CPC ..... *G03G 15/6511* (2013.01); *B65H 3/14* (2013.01); *G03G 15/6558* (2013.01); *G03G 2215/004* (2013.01)

(58) Field of Classification Search
CPC ..... B65H 3/14; B65H 3/08; B65H 3/0816; G03G 15/6511; G03G 15/6558; G03G 2215/004
See application file for complete search history.

(56) References Cited

U.S. PATENT DOCUMENTS

| | | | | |
|---|---|---|---|---|
| 8,113,501 | B2 * | 2/2012 | Uji | B65H 3/48 271/97 |
| 2007/0194514 | A1 * | 8/2007 | Ikeda | B65H 3/48 271/97 |
| 2007/0273080 | A1 * | 11/2007 | Toya | B65H 1/24 271/146 |
| 2015/0217954 | A1 * | 8/2015 | Fujikura | B65H 3/48 271/90 |
| 2016/0016740 | A1 | 1/2016 | Niikura et al. | |

FOREIGN PATENT DOCUMENTS

| | | | |
|---|---|---|---|
| JP | 2005-335885 | * | 12/2005 |
| JP | 2016-000653 | A | 1/2016 |
| WO | WO99/44929 | * | 9/1999 |

* cited by examiner

*Primary Examiner* — Thomas A Morrison
(74) *Attorney, Agent, or Firm* — Oliff PLC

(57) ABSTRACT

A supply device includes: a loading portion where recording media are loaded; a transport unit to transport the media; a contact portion provided on the loading portion, the contact portion being in contact with a side end portion of the media having a first size in a direction intersecting with a transport direction, the contact portion having a blowing portion to blow air to the side end portion; a guide portion detachably attached to the contact portion when media having a second size smaller than the media having the first size are loaded, the guide portion being configured to guide a side end portion of the media having the second size; and a duct provided in the guide portion, the duct including a discharge port to blow the air from the blowing portion to an upper end portion of the media having the second size loaded on the loading portion.

14 Claims, 14 Drawing Sheets

SUPPLY DEVICE AND IMAGE FORMING APPARATUS

CROSS-REFERENCE TO RELATED APPLICATIONS

This application is based on and claims priority under 35 USC 119 from Japanese Patent Application No. 2020-153092 filed Sep. 11, 2020.

BACKGROUND

(i) Technical Field

The present disclosure relates to a supply device and an image forming apparatus.

(ii) Related Art

JP-A-2016-000653 discloses a sheet feeding device including: a housing; a sheet feeding tray that includes a loading plate on which sheets are loaded and is slidably attached to inside and outside of the housing; a transport unit that transports the sheets loaded on the loading plate in a direction orthogonal to both a sliding direction of the sheet feeding tray and a loading direction of the sheets; a long sheet option that is detachably attached to an upstream portion in a transport direction of the loading plate and includes an extension plate that extends the loading plate such that long sheets can be mounted; and a first locking unit that can hold the sheet feeding tray at a first locking position where the sheet feeding tray cannot slide when the long sheet option is attached and can hold the sheet feeding tray at a first unlocking position where the sheet feeding tray can slide when the long sheet option is removed.

SUMMARY

For example, when a small-sized sheet such as a postcard is to be travelled, an auxiliary guide for the small-sized sheet may be attached to a side guide. In this case, in a configuration that blows air to a side end portion of plural sheets so as to separate a sheet, the side end portion of the sheets is far from a discharge port of air in a state where the auxiliary guide for the small-sized sheet is attached. For this reason, a desired amount of air cannot be blown to an aiming position of the small-sized sheet, and there is a concern about occurrence of multi-feed of sheets.

Aspects of non-limiting embodiments of the present disclosure relate to a supply device and an image forming apparatus that, as compared with a configuration in which air is blown from a blowing port provided in a contact portion when recording media having a second size smaller than a first size are accommodated, prevents multi-feed of the recording media having the second size.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a supply device including: a loading portion on which recording media are loaded; a transport unit configured to transport the recording media loaded on the loading portion; a contact portion provided on the loading portion, the contact portion being in contact with a side end portion of the recording media having a first size in a direction intersecting with a transport direction, the contact portion having a blowing portion configured to blow air to the side end portion; a guide portion detachably attached to the contact portion when recording media having a second size smaller than the recording media having the first size are loaded, the guide portion being configured to guide a side end portion of the recording media having the second size; and a duct provided in the guide portion, the duct including a discharge port configured to blow the air from the blowing portion to an upper end portion of the recording media having the second size and loaded on the loading portion.

BRIEF DESCRIPTION OF THE DRAWINGS

Exemplary embodiment(s) of the present disclosure will be described in detail based on the following figures, wherein.

DETAILED DESCRIPTION

Figure 1:
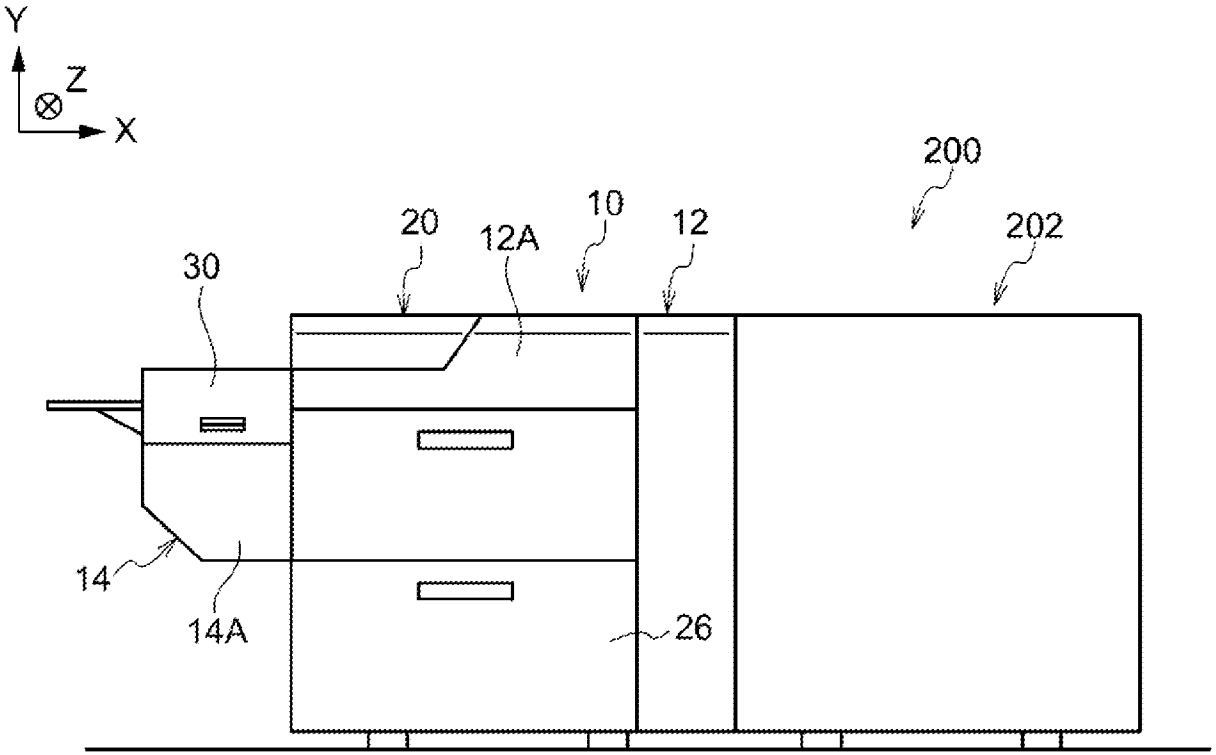
FIG. 1 is a front view showing an image forming apparatus including a sheet feeding device according to a first exemplary embodiment.

Exemplary embodiments of the present disclosure will be described below. In the following description, a direction indicated by an arrow X appropriately shown in the drawings is referred to as an "apparatus width direction", and a direction indicated by an arrow Y is referred to as an "apparatus height direction". A direction (arrow Z direction) orthogonal to the apparatus width direction and the apparatus height direction is referred to as an "apparatus depth direction".

First Exemplary Embodiment

Configuration of Image Forming Apparatus

FIG. 1 is a front view of an example of an image forming apparatus 200 including a sheet feeding device 10 according to a first exemplary embodiment.

As shown in FIG. 1, the image forming apparatus 200 includes an image forming apparatus main body 202 (an example of an image forming unit) that forms an image on a recording medium, and the sheet feeding device 10 that feeds the recording medium to the image forming apparatus main body 202. The sheet feeding device 10 is an example of a supply device. The sheet feeding device 10 is disposed adjacent to a side portion of the image forming apparatus main body 202. Although not shown, the image forming apparatus main body 202 includes an image forming unit that forms the image on the recording medium, and a transport unit that transports the recording medium to the image forming unit. Configurations and arrangements of the image forming unit and the transport unit are not particularly limited. The sheet feeding device 10 is optionally attached to the image forming apparatus main body 202, and can be independently traded in the market.

Configuration of Sheet Feeding Device

Overall Configuration

Figure 2:
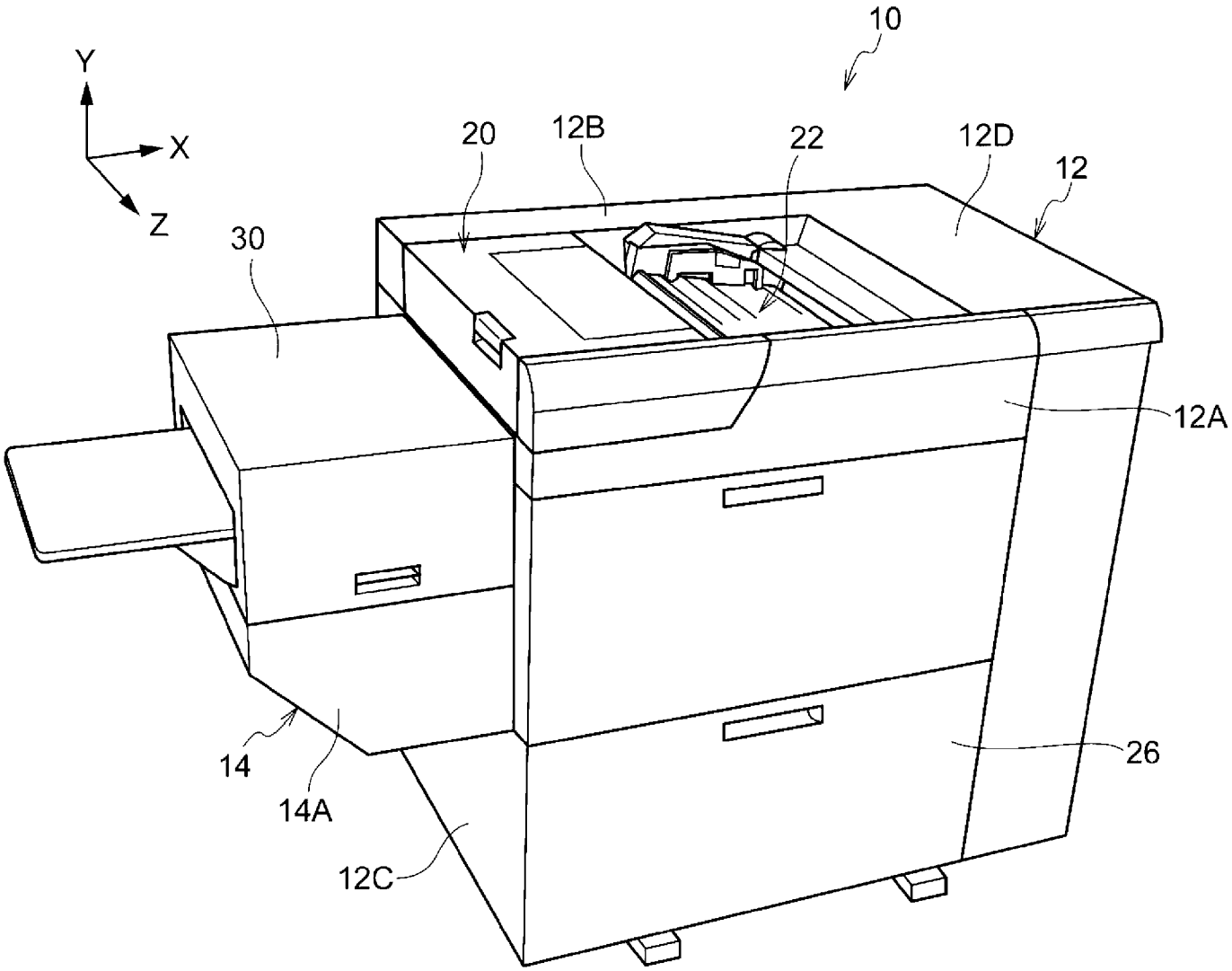
FIG. 2 is a perspective view showing the sheet feeding device according to the first exemplary embodiment.

FIG. 2 is a perspective view of the sheet feeding device 10 according to the first exemplary embodiment. As shown in FIG. 2, the sheet feeding device 10 includes a main body portion 12 as an device main body, and an accommodating device 14 attached so as to protrude from a side portion of the main body portion 12 toward an outside of the main body portion 12. A loading portion 16 on which plural recording media P are loaded is provided inside the sheet feeding device 10 (see FIG. 3). The accommodating device 14 is an example of an accommodating member detachably attached to the main body portion 12. The accommodating device 14 is retrofittable to the sheet feeding device 10 optionally.

Figure 3:
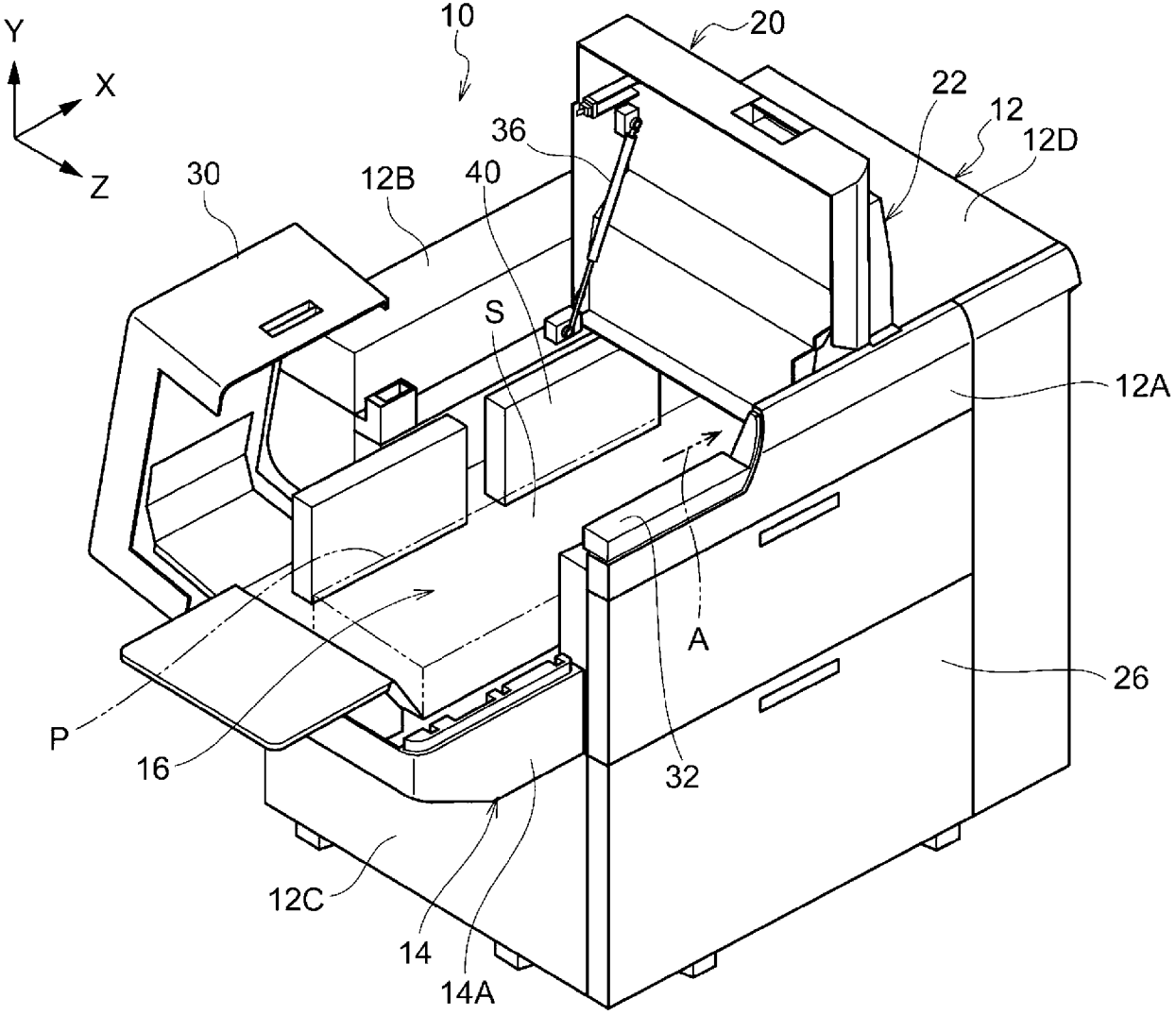
FIG. 3 is a perspective view showing a state where an opening-closing member and a rotating member which are used in the sheet feeding device according to the first exemplary embodiment are rotated to open a loading space on a loading portion.

As shown in FIGS. 2 and 3, the sheet feeding device 10 includes an opening-closing member 20 disposed on an upper surface of the main body portion 12 and provided at a position so as to cover an upper side of the loading portion 16. The opening-closing member 20 opens and closes a loading space S on the loading portion 16 in the main body portion 12. The sheet feeding device 10 includes a damper 36 that assists an opening operation of the loading space S by the opening-closing member 20 (see FIG. 3). Further, the sheet feeding device 10 includes a rotating member 22 that is disposed so as to at least partially overlap with the opening-closing member 20 and is rotatable. A recording medium for manual feeding may be placed in a state where the rotating member 22 is disposed so as to overlap with the opening-closing member 20. An opening-closing cover 30 that opens and closes the loading space S on the loading portion 16 is provided at a portion of the accommodating device 14 protruding from the side portion of the main body portion 12.

The sheet feeding device 10 includes, on an upper side of the loading space S, a transport unit 80 (see FIG. 13) that transports the uppermost recording medium P among the plural recording media P loaded on the loading portion 16. The recording media P loaded on the loading portion 16 are transported one by one in a transport direction (arrow A direction) along the apparatus width direction by the transport unit 80, as shown in FIG. 3. The recording medium P is an example of a recording medium having a first size. The sheet feeding device 10 includes a contact portion 40 that is in contact with a side end portion, in a direction intersecting with the transport direction, of the recording media P having the first size and loaded on the loading portion 16 (see FIG. 5).

Figure 4:
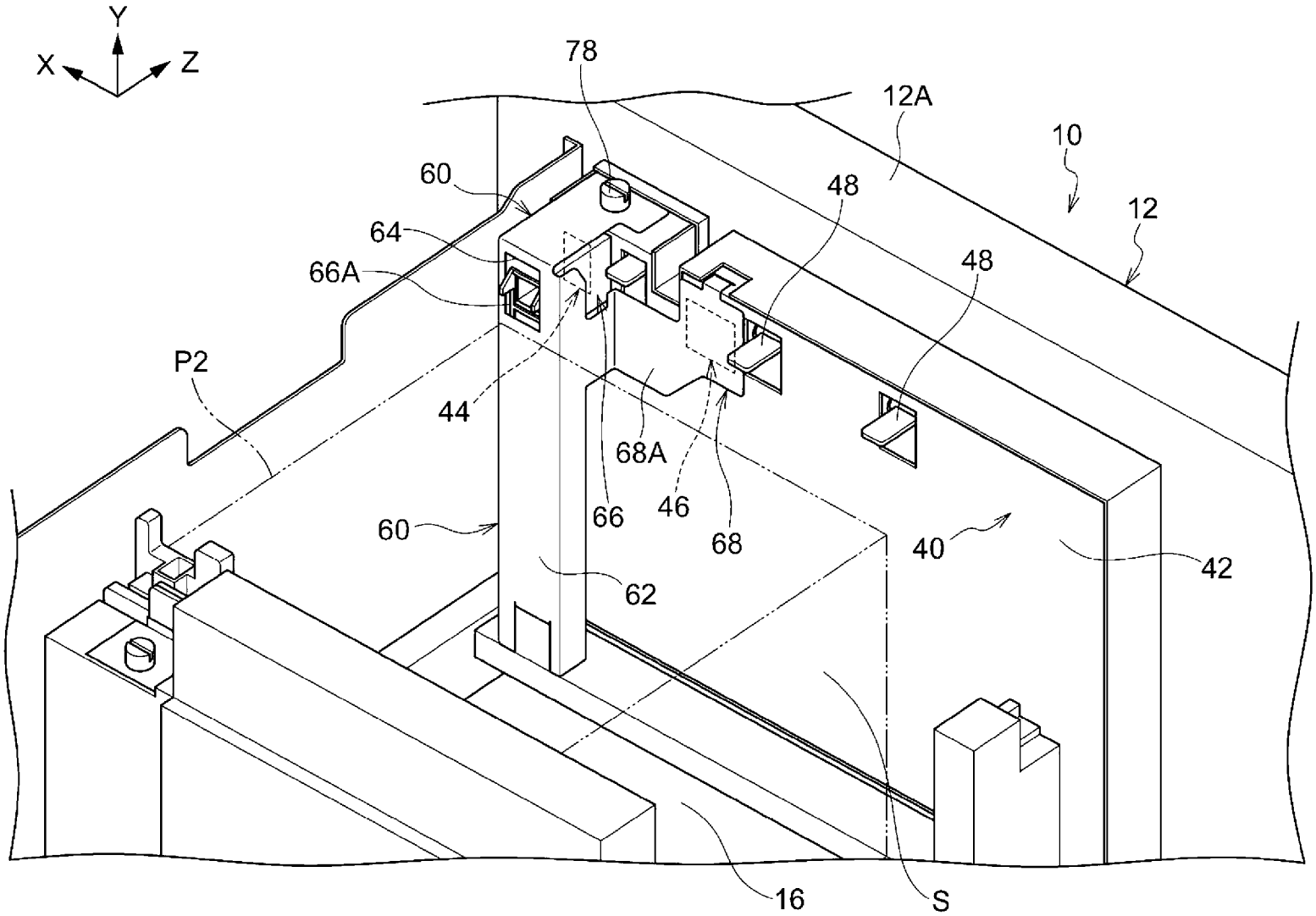
FIG. 4 is a perspective view showing a state where a guide portion is attached when recording media having a second size smaller than a first size are loaded on the loading portion of the sheet feeding device according to the first exemplary embodiment.

Further, as shown in FIG. 4, the sheet feeding device 10 includes a guide portion 60 that is detachably attached to the contact portion 40 when recording media P2 having a second size smaller than the recording media P having the first size are loaded on the loading portion 16.

As shown in FIGS. 2 and 3, the sheet feeding device 10 includes a pulling-out tray 26 in which recording media (not shown) different from the recording media P are stored in a lower portion on a front side of the main body portion 12 in a depth direction (that is, Z direction). The pulling-out tray 26 is pulled out from the main body portion 12, so that the recording media (not shown) different from the recording media P are stored.

Configuration of Main Body Portion 12

As shown in FIGS. 2 and 3, the main body portion 12 serve as a housing of the sheet feeding device 10. The main body portion 12 includes a front wall 12A disposed on a front side in the apparatus depth direction (that is, Z direction) and a rear wall 12B disposed on a back side in the apparatus depth direction. The main body portion 12 includes a side wall 12C disposed on one side in the apparatus width direction (that is, X direction) and a side wall (not shown in FIG. 2) disposed on the other side in the apparatus width direction. The front wall 12A is configured with plural panels. The pulling-out tray 26 is provided in a range excluding an upper side of the front wall 12A and the other side of the front wall 12A in the apparatus width direction.

The main body portion 12 includes an upper wall 12D disposed on the front wall 12A, the rear wall 12B, the side wall 12C and the other side wall (not shown in FIG. 2). Upper ends of the front wall 12A and the rear wall 12B are connected to the upper wall 12D, and a part of the loading space S is covered with the upper wall 12D.

The front wall 12A and the rear wall 12B sandwich the loading space S on the loading portion 16 from both sides in a direction intersecting with the transport direction of the recording medium P, that is, the apparatus depth direction indicated by the arrow Z. The front wall 12A is provided with a cutout portion 32 in which a height of a portion opposite to the upper wall 12D is lower than a height of a portion of the front wall 12A that is connected to the upper wall 12D.

Configuration of Accommodating Device 14

The accommodating device 14 has a function of accommodating the plural recording media P. As shown in FIGS. 2 and 3, the accommodating device 14 protrudes from above the side wall 12C of the main body portion 12 toward the outside of the main body portion 12. The accommodating device 14 is disposed across (i) a position between the front wall 12A and the rear wall 12B and (ii) an outside of the side wall 12C. That is, the accommodating device 14 is detachably attached to an upper side of the side wall 12C between the front wall 12A and the rear wall 12B of the main body portion 12. The accommodating device 14 includes a main body portion 14A and the opening-closing cover 30 provided on an upper side of the main body portion 14A.

The loading portion 16 on which the plural recording media P are loaded is provided inside the accommodating device 14 (see FIG. 3). As an example, the recording medium P loaded on the loading portion 16 is a recording medium having a length longer than a length of a recording medium having an A3 size in a longer direction. For example, the length of the recording medium P in the longer direction is 900 mm or 1200 mm.

In the sheet feeding device 10, the recording media P loaded on the loading portion 16 are transported one by one in the arrow A direction by the transport unit 80 (see FIG. 13) disposed on an upper wall 12D side inside the main body portion 12. The loading portion 16 protrudes from between the front wall 12A and the rear wall 12B to an upstream side in the transport direction (that is, arrow A direction) of the recording medium P. That is, in the sheet feeding device 10, an upper part of the side wall 12C between the front wall 12A and the rear wall 12B is opened toward the upstream side in the transport direction of the recording medium P, and the loading portion 16 is disposed across the opened portion.

The opening-closing cover 30 is configured to be rotated along the apparatus depth direction by a hinge (not shown) provided on the back side of the main body portion 14A in the apparatus depth direction (that is, Z direction) (see FIG. 3). By rotating the opening-closing cover 30 upward from the front side toward the back side in the apparatus depth direction (Z direction), a part of the loading space S on the loading portion 16 is opened.

Configuration of Opening-Closing Member 20 and Rotating Member 22

The opening-closing member 20 has a function of opening the loading space S on the loading portion 16 in cooperation with the opening-closing cover 30 in a shared manner so as to load the plural recording media P on the loading portion 16. As shown in FIGS. 2 and 3, the opening-closing member 20 is provided between upper portions of the front wall 12A and the rear wall 12B. The opening-closing member 20 is disposed on an upper surface of the main body portion 12 in a state where the loading space S on the loading portion 16 is closed. The opening-closing member 20 is rotated around a hinge (not shown) provided on one end in the transport direction (that is, the arrow A direction shown in FIG. 3) of the recording medium P to open and close the loading space S (see FIG. 3) on the loading portion 16.

The rotating member 22 allows placing of a recording medium for manual feeding (not shown) different from the recording medium P on the rotating member 22. The rotating member 22 is rotated around the hinge (not shown) provided on one end in the transport direction (that is, the arrow A direction shown in FIG. 3) of the recording medium P. The rotating member 22 is configured to shift from a posture overlapping with the opening-closing member 20 to a standing posture in response to an operation of opening the loading space S by the opening-closing member 20.

Configuration of Contact Portion 40

Figure 5:
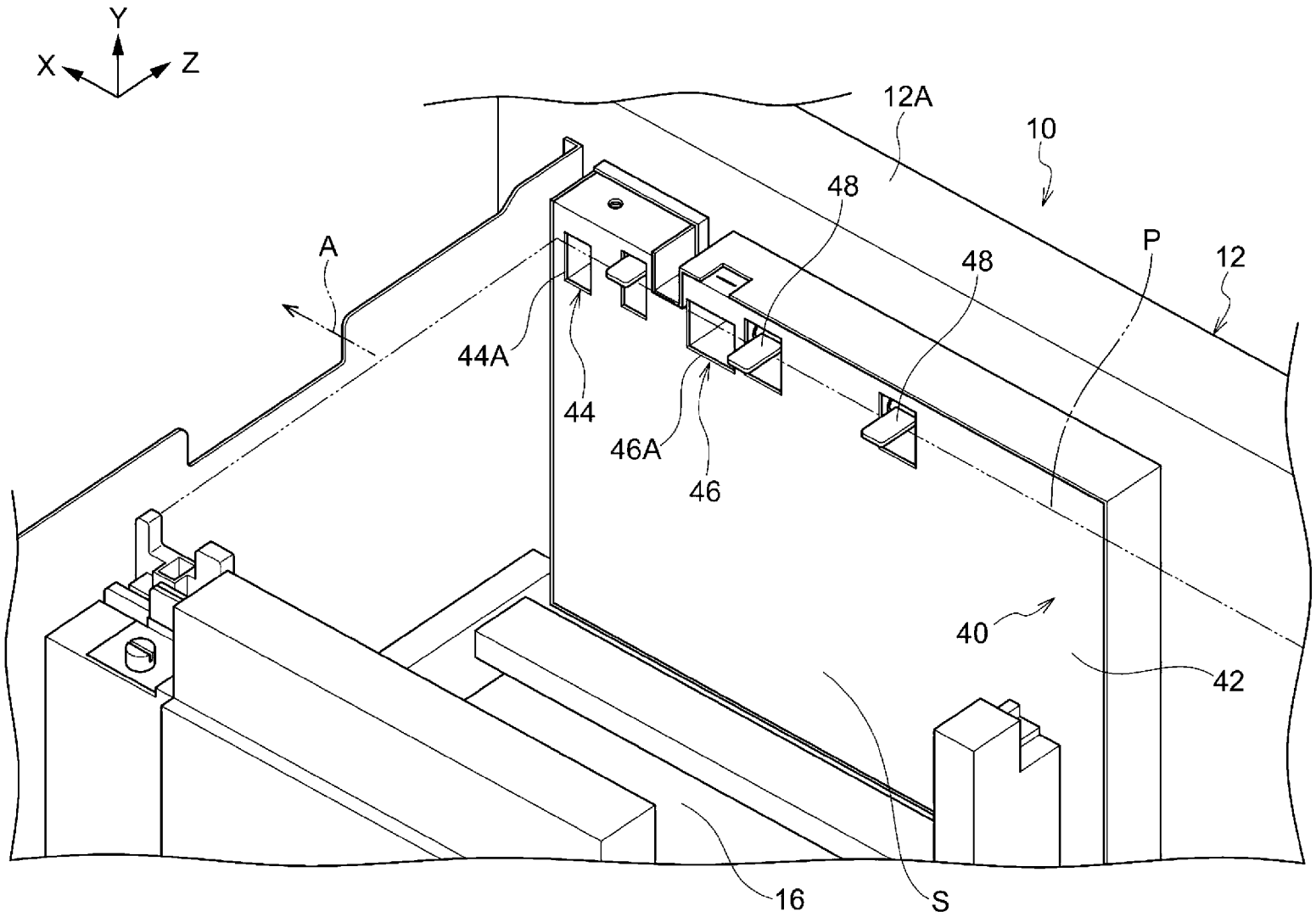
FIG. 5 is a perspective view showing a contact portion coming into contact with recording media having the first size in a state where the guide portion is removed in the loading portion of the sheet feeding device according to the first exemplary embodiment.

As shown in FIG. 5, the contact portion 40 has a function of (i) coming into contact with the side end portion, in the direction intersecting with the transport direction, of the recording media P having the first size and loaded on the loading portion 16 and (ii) guiding the recording media P having the first size. The contact portion 40 includes a vertical wall portion 42 disposed along an upper and lower direction. The vertical wall portion 42 is also disposed along the transport direction (that is, the arrow A direction shown in FIG. 3) of the recording medium P. The contact portion 40 includes a first blowing portion 44 and a second blowing portion 46 on an upper portion of the vertical wall portion 42. The first blowing portion 44 and the second blowing portion 46 blow air to a side wall portion of the recording media P having the first size in the direction intersecting with the transport direction (arrow A direction). Here, the first blowing portion 44 is an example of a blowing portion, and the second blowing portion 46 is an example of another blowing portion. Further, the contact portion 40 includes sensors 48 that detect a position of the uppermost surface of the recording media P loaded on the loading portion 16. For example, plural sensors 48 are arranged in the transport direction of the recording medium P.

The first blowing portion 44 and the second blowing portion 46 have the same height in the upper and lower direction. In a state where the recording media P having the first size are loaded on the loading portion 16, the first blowing portion 44 and the second blowing portion 46 are arranged on the upper side of the loaded recording media P along the transport direction of the recording medium P. The first blowing portion 44 is disposed downstream of the second blowing portion 46 in the transport direction of the recording medium P. The first blowing portion 44 includes a blowing port 44A that blows air to the side end portion of the recording media P. The second blowing portion 46 includes a blowing port 46A that blows air to the side end portion of the recording media P.

Figure 6:
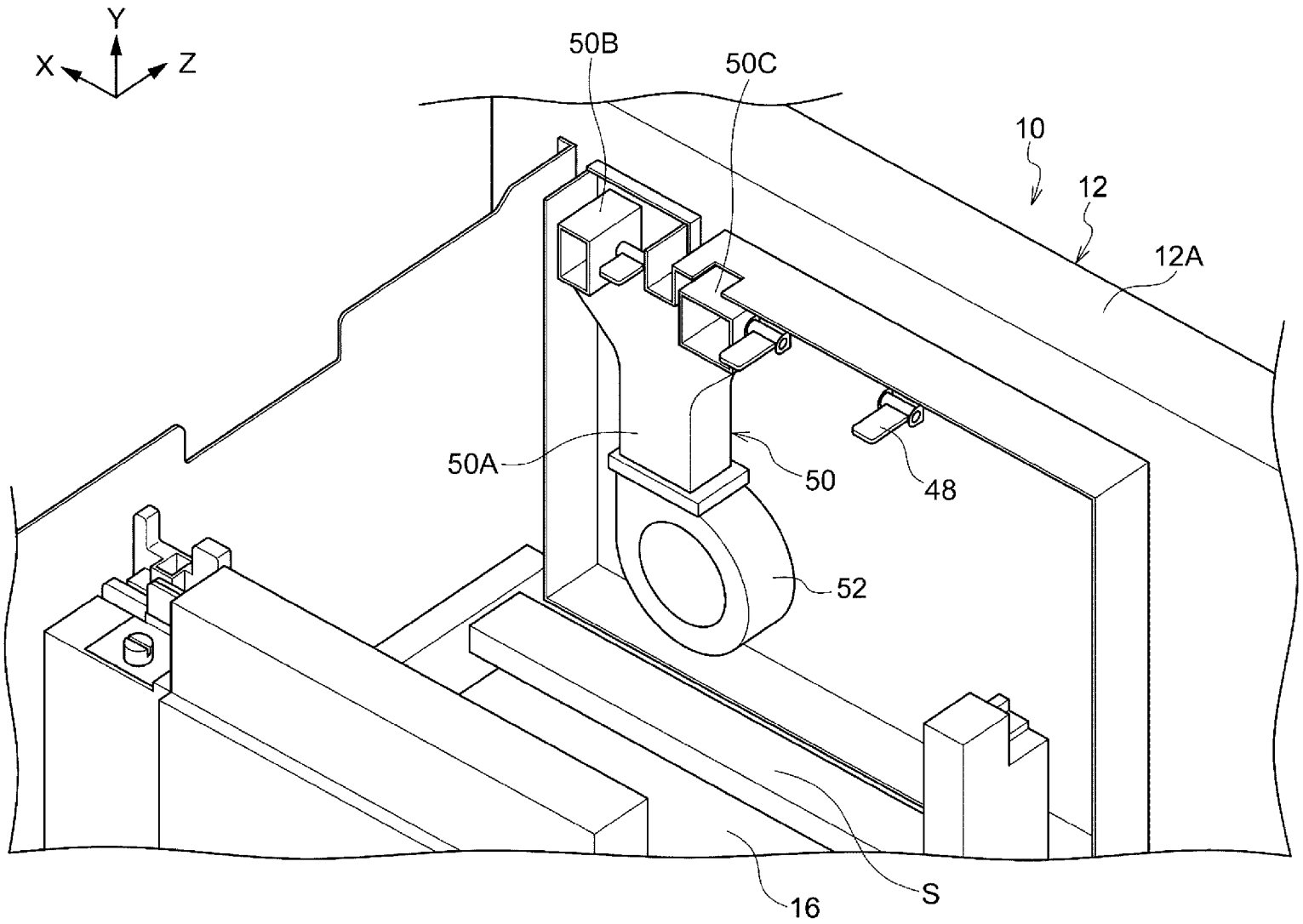
FIG. 6 is a perspective view showing a duct and a blower that supply air to a blowing portion of the contact portion in the loading portion of the sheet feeding device according to the first exemplary embodiment.

FIG. 6 shows a state where the vertical wall portion 42 of the contact portion 40 is removed. As shown in FIG. 6, a duct 50 is connected to the blowing ports 44A and 46A. The duct 50 includes one flow channel 50A disposed upstream in an air flow direction, and branch portions 50B and 50C, into which the flow channel 50A branches, downstream of the flow channel 50A in the air flow direction. Downstream end portions of the branch portions 50B and 50C are respectively connected to the blowing ports 44A and 46A (see FIG. 5). The blowing ports 44A and 46A have, for example, a rectangular shape.

A blower 52 that supplies air to the duct 50 is provided at an upstream end portion of the flow channel 50A of the duct 50. When air is supplied to the duct 50 by the blower 52, air is blown from the first blowing portion 44 and the second blowing portion 46 to the side end portion of the recording media P. In the present exemplary embodiment, air is blown from the first blowing portion 44 and the second blowing portion 46 to an upper side wall portion of the plural recording media P loaded on the loading portion 16.

Configuration of Guide Portion 60

As described above, the guide portion 60 is detachably attached to the contact portion 40 when the recording media P2 having the second size are loaded on the loading portion 16. When plural (for example, two) contact portions 40 are arranged along the transport direction of the recording medium P2 on the loading portion 16 (see FIG. 3), the guide portion 60 is attached to the contact portion 40 disposed downstream of the guide portion 60 in the transport direction of the recording medium P2. As shown in FIG. 4, the guide portion 60 has a function of (i) coming into contact with the side end portion, in the direction intersecting with the transport direction, of the recording media P2 having the second size and loaded on the loading portion 16 and (ii) guiding the recording media P2 having the second size. Although not shown, the guide portions 60 may be provided on both sides, in a width direction, of the recording media P2 having the second size or may be provided on one side, in the width direction, of the recording media P2 having the second size. Instead of these, the guide portion 60 may be provided on one side, in the width direction, of the recording media P2 having the second size, and another guide portion may be provided on the other side, in the width direction, of the recording media P2 having the second size.

Figure 7:
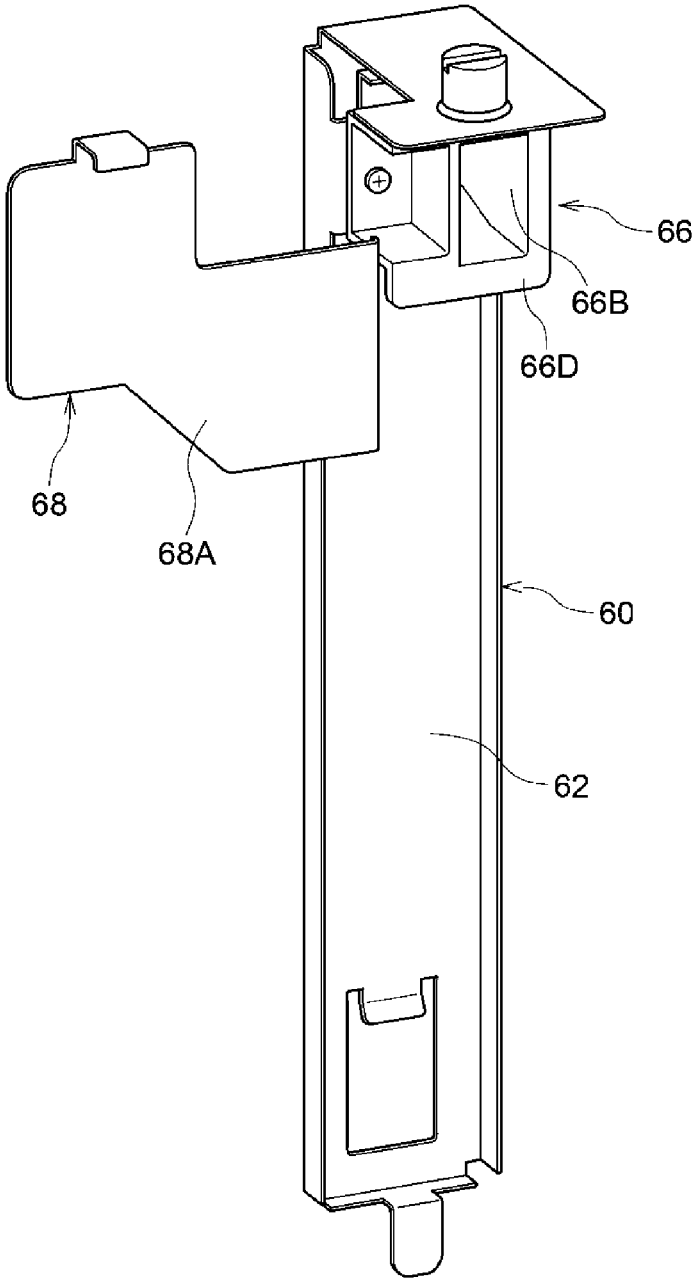
FIG. 7 is a perspective view showing a duct side of the guide portion used in the sheet feeding device according to the first exemplary embodiment.
Figure 8:
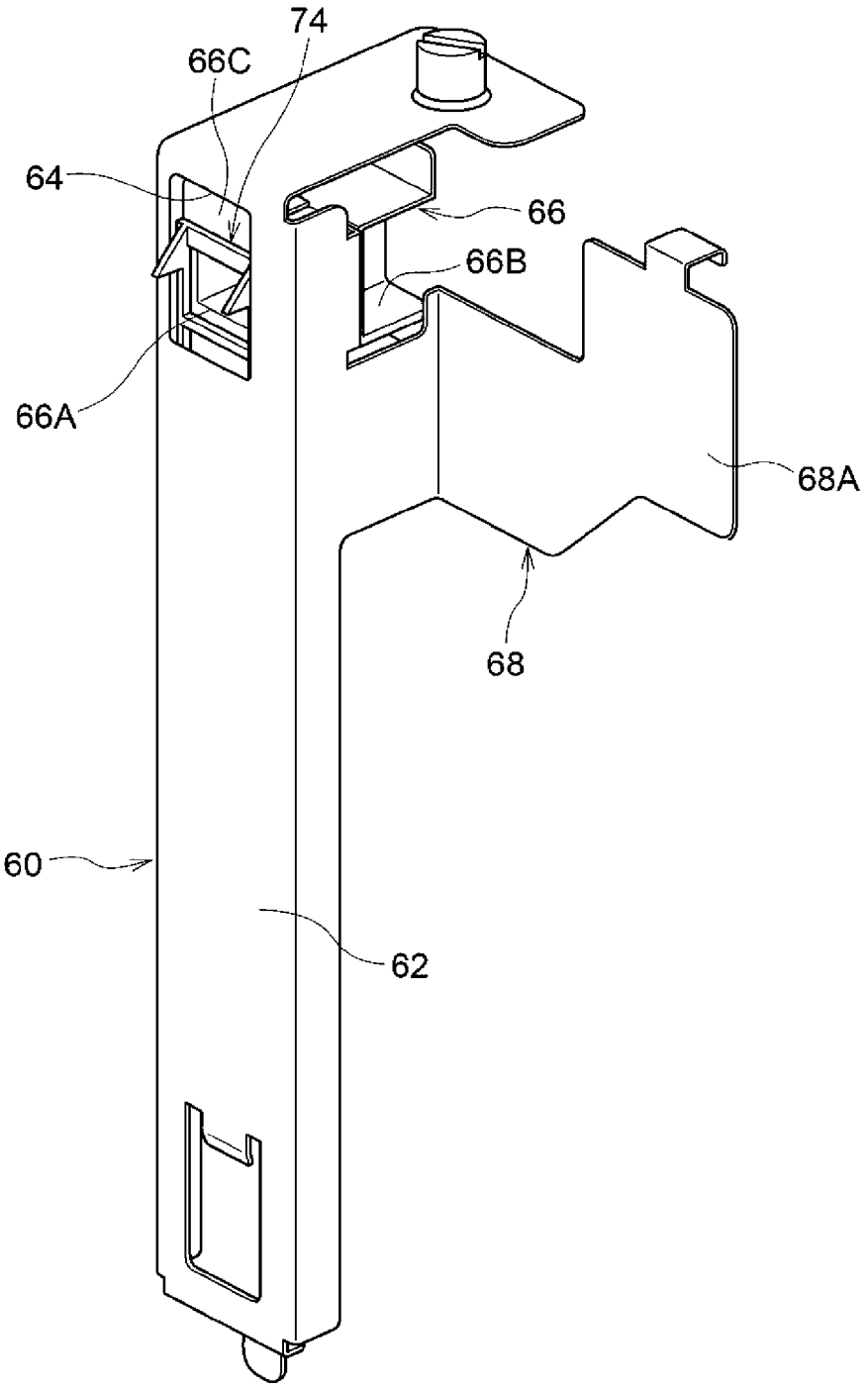
FIG. 8 is a perspective view showing a discharge port side of the guide portion used in the sheet feeding device according to the first exemplary embodiment.

As shown in FIGS. 4, 7, and 8, the guide portion 60 includes a vertical wall portion 62 extending in the upper and lower direction and a duct 66 provided on an upper portion of the vertical wall portion 62. The duct 66 includes a discharge port 66A that blows air to a side wall portion of the recording medium P2 in the direction intersecting with the transport direction. For example, a lower portion of the guide portion 60 is in contact with the loading portion 16, and an upper portion of the guide portion 60 is in contact with the contact portion 40. In this state, the upper portion of the guide portion 60 is fixed to an upper portion of the contact portion 40 by a fixing member 78. The duct 66 is connected to the first blowing portion 44 in a state where the guide portion 60 is attached to the contact portion 40 (see FIG. 4). Further, the guide portion 60 includes a closing portion 68 that closes the second blowing portion 46 in a state of being attached to the contact portion 40 (see FIG. 4).

In a state where the guide portion 60 is attached to the contact portion 40, the vertical wall portion 62 is able to come into contact with the side wall portion of the recording media P2 having the second size in the direction intersecting with the transport direction. As an example, the vertical wall portion 62 and the duct 66 are formed separately. An opening 64 is formed on the upper portion of the vertical wall portion 62, and a discharge port 66A of the duct 66 is connected to the opening 64. As an example, the opening 64 and the discharge port 66A have a rectangular shape, and a size of the discharge port 66A is smaller than a size of the opening 64.

Figure 9:
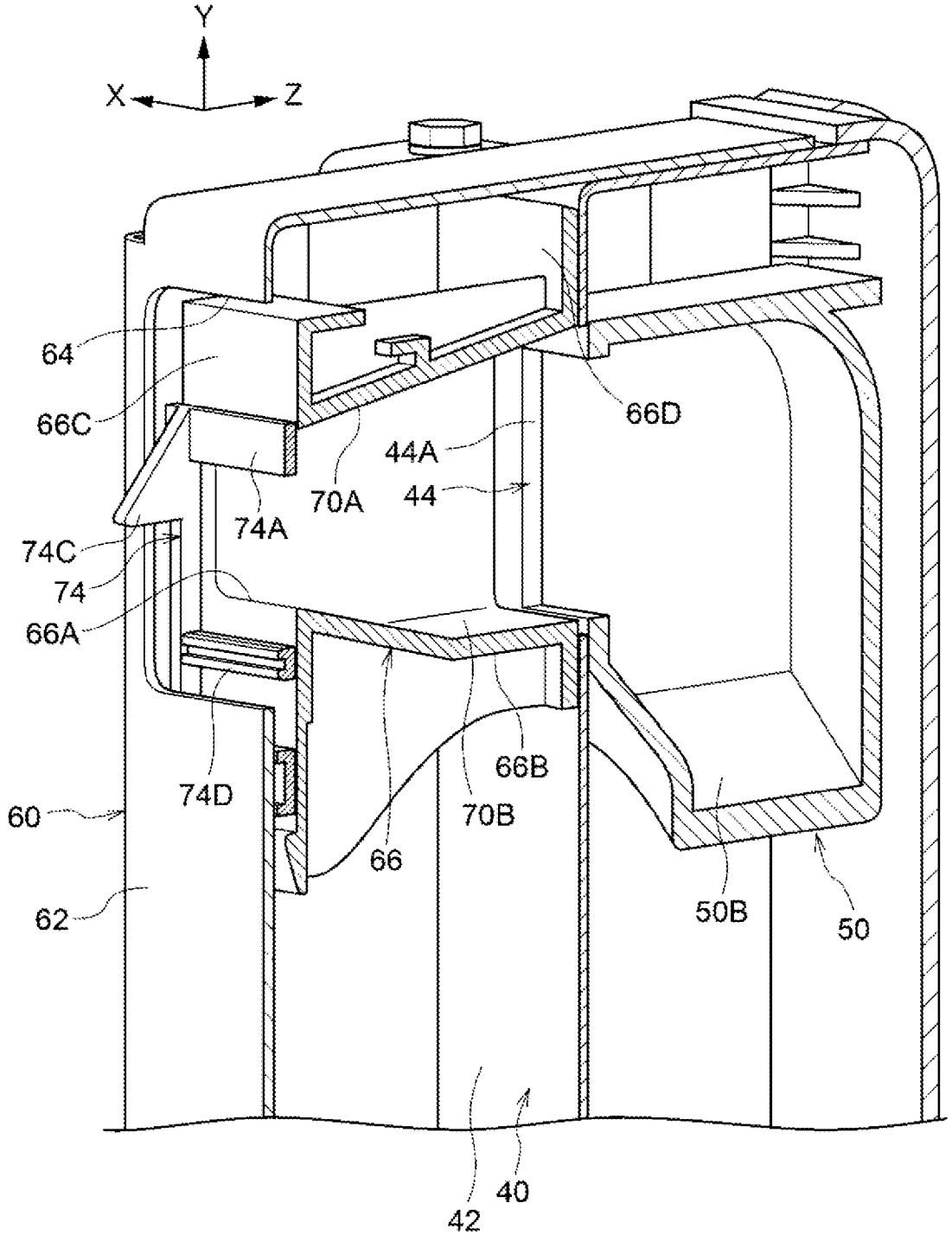
FIG. 9 is a perspective view showing the duct of the guide portion used in the sheet feeding device according to the first exemplary embodiment, which is partially cut and removed.

As shown in FIG. 9, the duct 66 includes a cylindrical portion 66B through which air flows. A discharge port 66A is provided at a downstream end portion of the cylindrical portion 66B in an air flow direction. The duct 66 includes a vertical wall 66C extending around the discharge port 66A at a downstream end portion of the cylindrical portion 66B in the air flow direction. Further, the duct 66 includes a vertical wall 66D extending around the cylindrical portion 66B at an upstream end portion of the cylindrical portion 66B in the air flow direction.

Since the size of the discharge port 66A is smaller than the size of the opening 64, the vertical wall 66C of the duct 66 is in contact with the vertical wall 62 in a state where the discharge port 66A of the duct 66 is connected to the opening 64 of the vertical wall portion 62. In a state where the cylindrical portion 66B of the duct 66 is connected to the blowing port 44A of the contact portion 40, the vertical wall 66D of the duct 66 is in contact with the vertical wall portion 42 of the contact portion 40.

The cylindrical portion 66B of the duct 66 has a shape in which a cross-sectional area gradually decreases toward the discharge port 66A. The cylindrical portion 66B of the duct 66 includes an upper inclined portion 70A at an upper portion thereof in the upper and lower direction, and a lower inclined portion 70B at a lower portion thereof in the upper and lower direction. The upper inclined portion 70A is inclined downward toward the discharge port 66A. The lower inclined portion 70B is inclined upward toward the discharge port 66A. As an example, the upper inclined portion 70A has a flat shape and has the same inclined angle with respect to a horizontal direction, in a flow direction. As an example, the lower inclined portion 70B is configured such that the inclined angle with respect to the horizontal direction is changed in an intermediate portion, and the inclined angle with respect to the horizontal direction on the downstream side in the air flow direction is larger than that on the upstream side in the air flow direction. A width of the cylindrical portion 66B of the duct 66 in the apparatus width direction (that is, X direction) is constant within a tolerance.

As shown in FIG. 4, the closing portion 68 extends from the vertical wall portion 62 to a vertical wall portion 42 side of the contact portion 40, and includes a flat portion 68A coming into contact with the vertical wall portion 42. The flat portion 68A comes into contact with a periphery of the blowing port 46A of the second blowing portion 46 in the vertical wall portion 42 to close the blowing port 46A. A packing formed of an elastic member or the like may be provided at a position where the closing portion 68 is in contact with the vertical wall portion 42, so as to prevent air leakage from the blowing port 46A.

Figure 10:
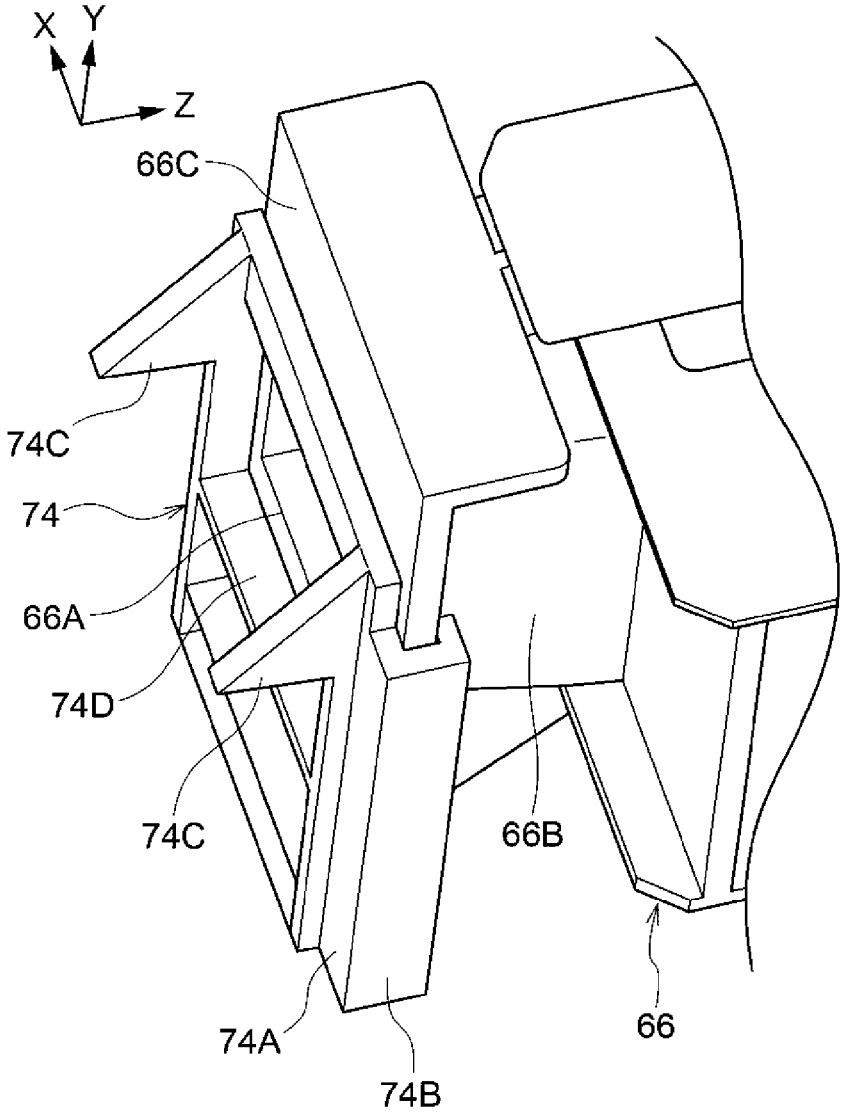
FIG. 10 is a perspective view showing a shutter portion provided at the discharge port of the guide portion used in the sheet feeding device according to the first exemplary embodiment.

A shutter portion 74 supported so as to be movable in the upper and lower direction is provided outside the discharge port 66A (see FIGS. 8 and 9). The shutter portion 74 is disposed between the vertical wall portion 62 and the vertical wall 66C (see FIG. 9). As shown in FIG. 10, the shutter portion 74 includes a frame body 74A slidably disposed along the vertical wall 66C, guides 74B provided on both sides of the frame body 74A in the width direction, and pawls 74C that protrude from an upper portion of the frame body 74A to a side opposite to the duct 66. Further, the shutter portion 74 is provided with a bar portion 74D that is bridged on the frame body 74A along the horizontal direction.

The frame body 74A is a rectangular member having an opening inside. The guide 74B is bent in a U shape along an outer end portion of the vertical wall 66C in the width direction from an end portion of the frame body 74A in the width direction. That is, the guide 74B wraps around from a front surface side of the vertical wall 66C that is in contact with the frame body 74A to a back surface side of the vertical wall 66C. The guides 74B on both sides of the frame body 74A in the width direction (it is noted that the guide 74B on a back side in FIG. 10 is not shown) are symmetrical. The two guides 74B are slidable in the upper and lower direction with respect to the vertical wall 66C in a state where the two guides 74B sandwich outer end portions of the vertical wall 66C in the width direction from both sides. A stopper 76 is provided on a lower side of the discharge port 66A, on the vertical wall 66C (see FIG. 12). The stopper 76 protrudes toward a shutter portion 74 side and restricts a movement of the shutter portion 74 toward a lower side.

A lower portion of the pawl 74C protrudes from the frame body 74A in the horizontal direction. The pawl 74C is disposed at a position where the pawl 74C comes into contact with the uppermost surface of the recording media P2 having the second size and loaded on the loading portion 16, from above. The pawl 74C is movable in the upper and lower direction according to the position of the uppermost surface of the recording media P2 having the second size by riding on the uppermost surface of the recording media P2 having the second size and loaded on the loading portion 16. Accordingly, the shutter portion 74 moves in the upper and lower direction in response to a movement of the pawl 74C.

The bar portion 74D is bridged on a lower side of the rectangular frame body 74A along the horizontal direction. Since the shutter portion 74 includes the bar portion 74D, an area of the discharge port 66A is changed according to the position of the uppermost surface of the recording media P2 having the second size and loaded on the loading portion 16. As an example, when the shutter portion 74 is moved upward according to the position of the uppermost surface of the recording media P2 having the second size and loaded on the loading portion 16, the bar portion 74D closes a lower side of the discharge port 66A in the upper and lower direction.

Figure 11:
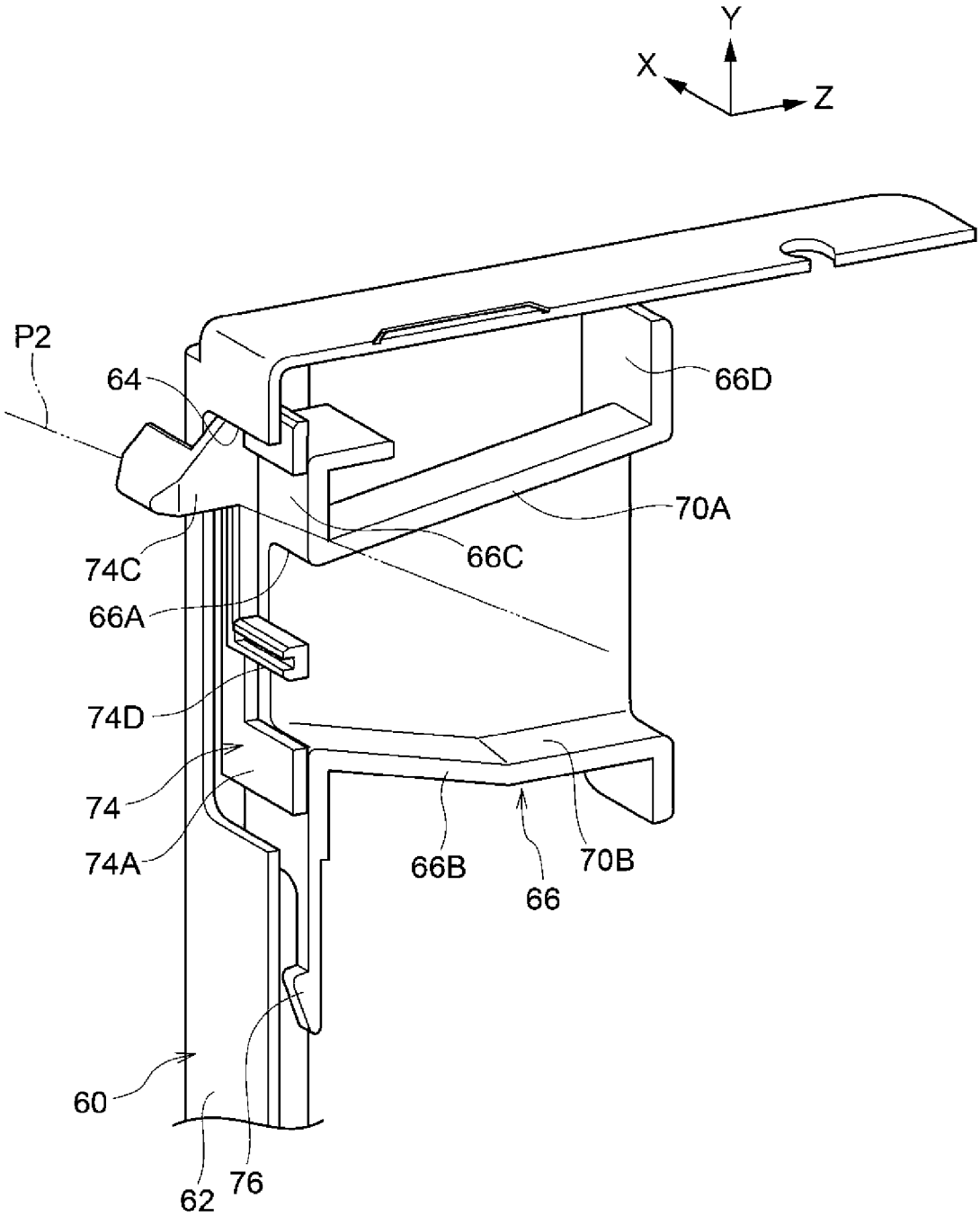
FIG. 11 is a perspective view showing a state where the shutter portion provided at the discharge port of the guide portion used in the sheet feeding device according to the first exemplary embodiment is moved upward, which is partially cut and removed.

As shown in FIG. 11, for example, when the position of the uppermost surface of the recording media P2 having the second size and loaded on the loading portion 16 is on the upper side in the upper and lower direction, the shutter portion 74 is moved upward in the upper and lower direction due to the movement of the pawl 74C riding on the uppermost surface of the recording media P2. In this case, the bar portion 74D closes a part of a lower side of the discharge port 66A, so that the area of the discharge port 66A is reduced. Accordingly, an amount of air blown to the side wall portion of the recording medium P2 having the second size that faces the bar portion 74D is reduced, and air is less likely to enter between the recording media P2 having the second size. Therefore, the position of the uppermost surface of the recording media P2 having the second size is easily moved downward.

Figure 12:
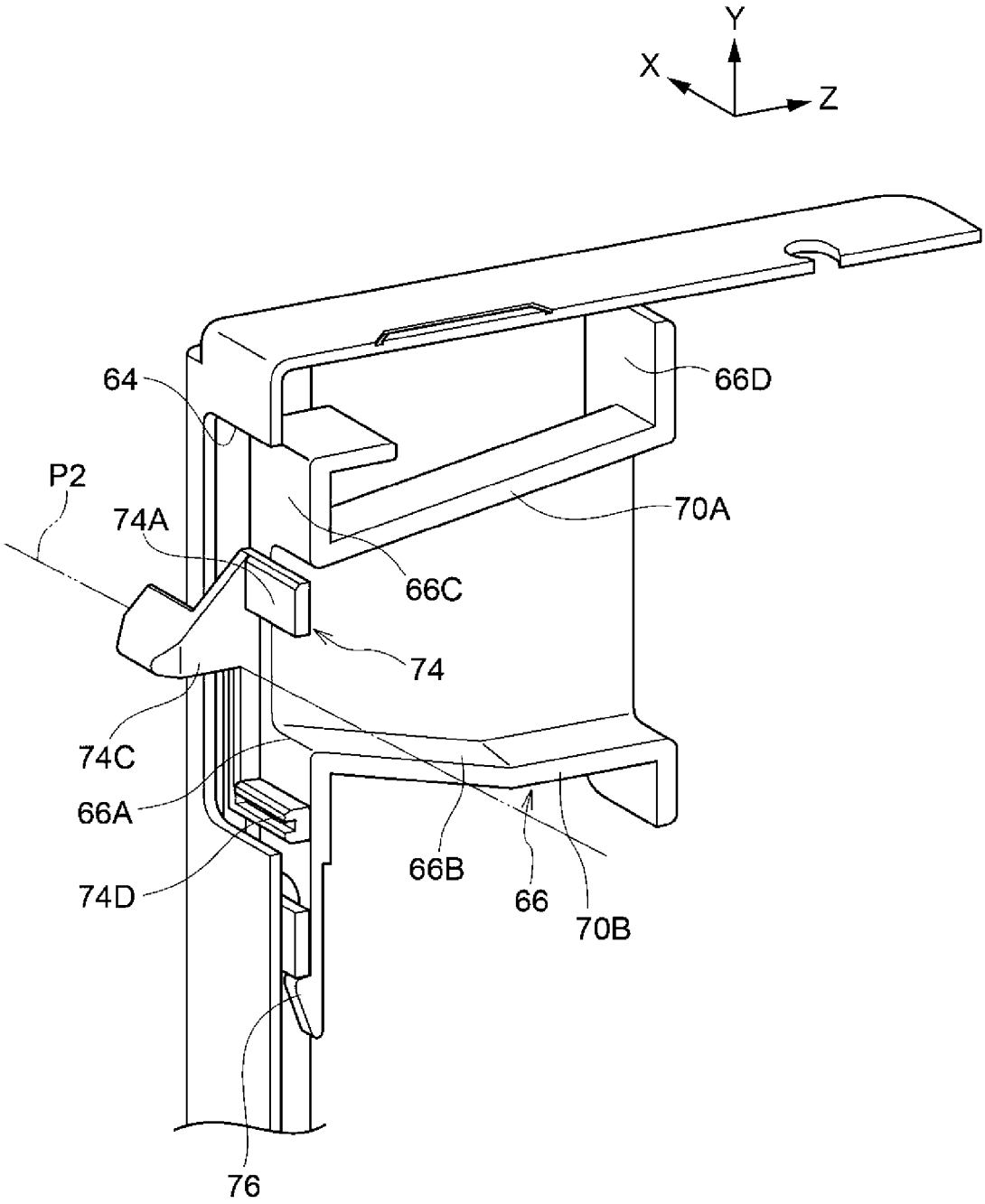
FIG. 12 is a perspective view showing a state where the shutter portion provided at the discharge port of the guide portion used in the sheet feeding device according to the first exemplary embodiment is moved downward, which is partially cut and removed.

As shown in FIG. 12, for example, when the uppermost surface of the recording media P2 having the second size and loaded on the loading portion 16 is on the lower side in the upper and lower direction, the shutter portion 74 is moved downward in the upper and lower direction due to the movement of the pawls 74C riding on the uppermost surface of the recording media P2. In this case, the upper portion of the frame body 74A closes a part of the upper side of the discharge port 66A, so that the area of the discharge port 66A is reduced. Accordingly, the amount of air blown from the discharge port 66A to the side wall portion of the recording media P2 having the second size increases, and air easily enters between the recording media P2 having the second size. Therefore, the position of the uppermost surface of the recording media P2 having the second size is easily moved upward.

Configuration of Transport Unit 80

Figure 13:
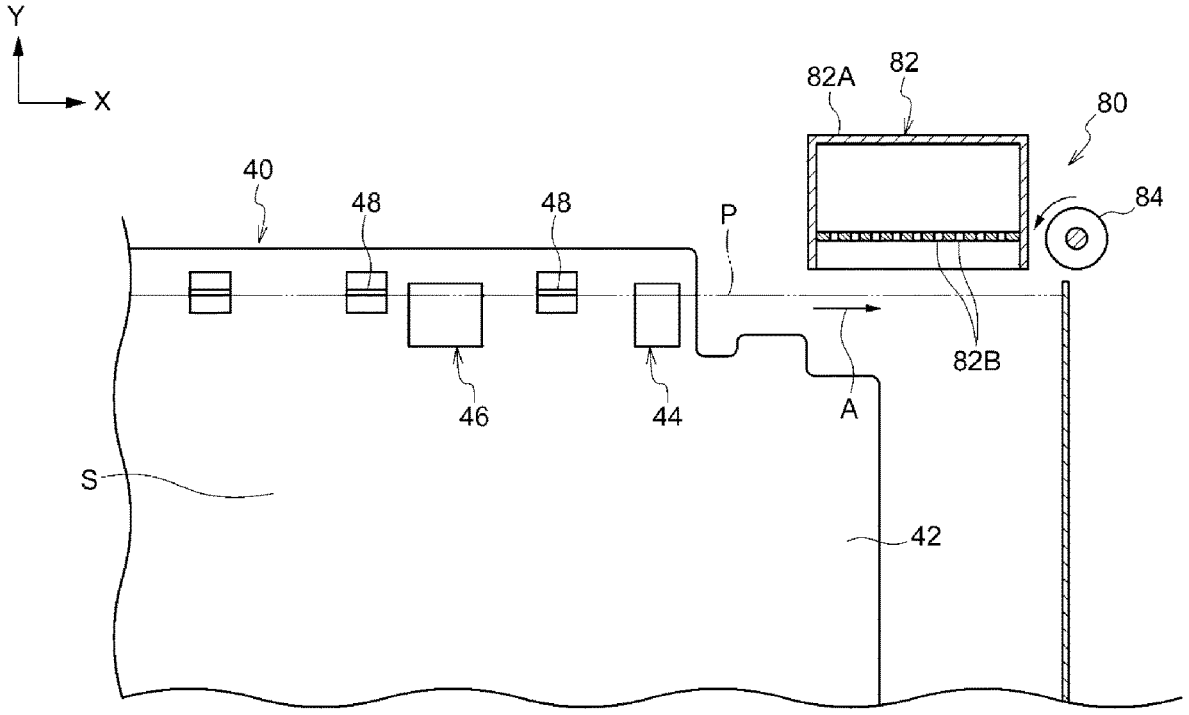
FIG. 13 is a cross-sectional view showing a transport unit that transports the recording medium loaded on the loading portion in the sheet feeding device according to the first exemplary embodiment.

As shown in FIG. 13, the transport unit 80 includes a suction unit 82 that suctions the uppermost recording medium P having the first size and loaded on the loading portion 16 from above, and a transport roller 84 that transports the uppermost recording medium P having the first size and loaded on the loading portion 16.

The suction unit 82 includes a housing 82A and plural suction ports 82B provided in a lower portion of the housing 82A, for suctioning air. The suction unit 82 suctions air through the suction ports 82B by a suction device (not shown) to suction the uppermost recording medium P having the first size and loaded on the loading portion 16.

The transport roller 84 has a function of feeding the uppermost recording medium P having the first size and loaded on the loading portion 16 by being rotated in an arrow direction. Accordingly, the uppermost recording medium P suctioned by the suction unit 82 is transported in the arrow A direction by the transport roller 84.

Although not shown, the transport unit 80 has a function of, when the recording medium P2 having the second size is loaded on the loading portion 16, transporting the uppermost recording medium P2 having the second size and loaded on the loading portion 16. The uppermost recording medium P2 having the second size and loaded on the loading portion 16 is suctioned by the suction unit 82. Further, the uppermost recording medium P2 having the second size and suctioned by the suction unit 82 is transported in the arrow A direction by the transport roller 84.

Operations and Effects

Next, operations and effects of the present exemplary embodiment will be described. In the sheet feeding device 10, when the recording media P having the first size are loaded on the loading portion 16, the side end portion of the recording media P having the first size in the direction intersecting with the transport direction comes into contact with the vertical wall portion 42 of the contact portion 40, so that the side end portion of the recording media P having the first size is guided. Further, air is blown from the first blowing portion 44 and the second blowing portion 46 that are provided in the contact portion 40 to the side end portion of the recording media P, so that the air is blown between the plural recording media P. Accordingly, the uppermost recording medium P is separated and transported in the arrow A direction by the transport unit 80.

In the sheet feeding device 10, when the recording media P2 having the second size smaller than the recording media P having the first size are loaded on the loading portion 16, the guide portion 60 is detachably attached to the contact portion 40. Accordingly, the side end portion of the recording media P2 having the second size in the direction intersecting with the transport direction comes into contact with the vertical wall portion 62 of the guide portion 60, so that the side end portion of the recording media P2 having the second size is guided.

The duct 66 including the discharge port 66A that blows air is provided on the guide portion 60. Air from the first blowing portion 44 is blown to an upper side end portion of the recording media P2 having the second size and loaded on the loading portion 16. That is, air from the first blowing portion 44 is blown to the side end portion of the recording media P2 having the second size via the discharge port 66A of the duct 66, so that air is blown between the plural recording media P2. Accordingly, the uppermost recording medium P2 having the second size is separated and transported in the arrow A direction by the transport unit 80.

In the sheet feeding device 10, when the recording media having the second size smaller than the first size are accommodated, the multi-feed of the recording media P2 having the second size is prevented as compared with a configuration in which air is blown from the blowing port provided in the contact portion.

In the sheet feeding device 10, the cylindrical portion 66B of the duct 66 has a shape in which the cross-sectional area gradually decreases toward the discharge port 66A. Therefore, in the sheet feeding device 10, a wind speed of air blown from the discharge port 66A can be increased as compared with a case where the cross-sectional area of the duct is constant toward the discharge port. By increasing the wind speed of air blown from the discharge port 66A, air is easily blown between the plural recording media P having the second size.

In the sheet feeding device 10, the cylindrical portion 66B of the duct 66 includes the upper inclined portion 70A at the upper portion in the upper and lower direction, and the lower inclined portion 70B at the lower portion in the upper and lower direction. The upper inclined portion 70A is inclined downward toward the discharge port 66A. The lower inclined portion 70B is inclined upward toward the discharge port 66A. For example, when the lower inclined portion is provided only on the lower portion of the cylindrical portion of the duct, an area of the lower side of the discharge port may be reduced. Further, for example, when the upper inclined portion is provided only on the upper portion of the cylindrical portion of the duct, an area of the upper side of the discharge port may be reduced. Therefore, in the sheet feeding device 10, as compared with a case where the inclined portion is provided on only one portion of the duct in the upper and lower direction, it is prevented that a range in the upper and lower direction in which air is blown to the recording media P2 having the second size and loaded on the loading portion 16 is biased to one of upper and lower sides and decreases.

In the sheet feeding device 10, the contact portion 40 includes the second blowing portion 46 that blows air to the upper side end portion of the recording media P having the first size in a state where the recording media P having the first size are loaded on the loading portion 16. Further, the guide portion 60 includes the closing portion 68 that closes the second blowing portion 46 in a state of being attached to the contact portion 40. Therefore, in the sheet feeding device 10, the amount of air blown from the discharge port 66A can be increased as compared with a case where air is supplied from two positions of the discharge port and another blowing portion to the duct.

In the sheet feeding device 10, the first blowing portion 44 is disposed downstream of the second blowing portion 46 in the transport direction of the recording medium P. Therefore, in the sheet feeding device 10, the multi-feed of the recording media P is prevented as compared with a configuration in which the blowing portion is disposed upstream of another blowing portion in the transport direction of the recording medium.

In the sheet feeding device 10, the guide portion 60 is provided with the shutter portion 74 supported so as to be movable in the upper and lower direction. The shutter portion 74 is moved in the upper and lower direction to change the area of the discharge port 66A according to the position of the uppermost surface of the recording media P2 having the second size and loaded on the loading portion 16. Therefore, in the sheet feeding device 10, the range of the air blown from the discharge port 66A can be adjusted according to the position of the uppermost surface of the recording media P2 having the second size, as compared with a configuration in which the area of the discharge port does not change.

In the sheet feeding device 10, the shutter portion 74 includes the pawls 74C riding on the uppermost surface of the recording media P2 having the second size and loaded on the loading portion 16. As a result, the pawl 74C is moved depending on the position of the uppermost surface of the recording media P2 having the second size, and the shutter portion 74 is moved in the upper and lower direction. Therefore, in the sheet feeding device 10, a structure that moves the shutter portion 74 is simple as compared with a configuration in which the shutter portion is moved by detecting the position of the uppermost surface of the recording media having the second size by a sensor.

In the sheet feeding device 10, the shutter portion 74 is provided with the bar portion 74D that closes the lower side of the discharge port 66A in the upper and lower direction when moved upward according to the position of the uppermost surface of the recording media P2 having the second size and loaded on the loading portion 16. As a result, the amount of air blown to the side wall portion, facing the bar portion 74D, of the recording media P2 having the second size is reduced, so that air is less likely to enter between the recording media P2 having the second size, and the position of the uppermost surface of the recording media P2 having the second size is easily moved downward. Therefore, in the sheet feeding device 10, the position of the uppermost surface of the recording media P2 having the second size may be lowered as compared with a configuration in which the lower side of the discharge port in the upper and lower direction is not closed when the uppermost surface of the recording media having the second size is moved upward.

In the sheet feeding device 10, the transport unit 80 includes the transport roller 84 that transports the uppermost recording medium P2 having the second size and loaded on the loading portion 16. Therefore, in the sheet feeding device 10, the multi-feed of the recording media P2 having the second size is prevented as compared with a configuration in which the transport roller is provided and air is blown from the blowing portion when the recording media having the second size are accommodated.

In the sheet feeding device 10, the transport unit 80 includes the suction unit 82 that suctions the uppermost recording medium P2 having the second size and loaded on the loading portion 16 from above. Therefore, in the sheet feeding device 10, the multi-feed of the recording media P2 having the second size is prevented as compared with a case where the uppermost recording medium having the second size and loaded on the loading portion is not suctioned.

The image forming apparatus 200 includes the sheet feeding device 10, and is configured such that the recording medium P having the first size or the recording medium P2 having the second size is transported from the sheet feeding device 10 to the image forming unit. Therefore, in the image forming apparatus 200, the multi-feed of the recording media P2 having the second size is prevented as compared with a configuration in which air is blown from the blowing port provided in the contact portion when the recording media having the second size are accommodated.

Second Exemplary Embodiment

Next, a sheet feeding device 100 according to a second exemplary embodiment will be described with reference to FIG. 14. The same components as those in the first exemplary embodiment are denoted by the same reference numerals, and the description thereof is omitted.

Figure 14:
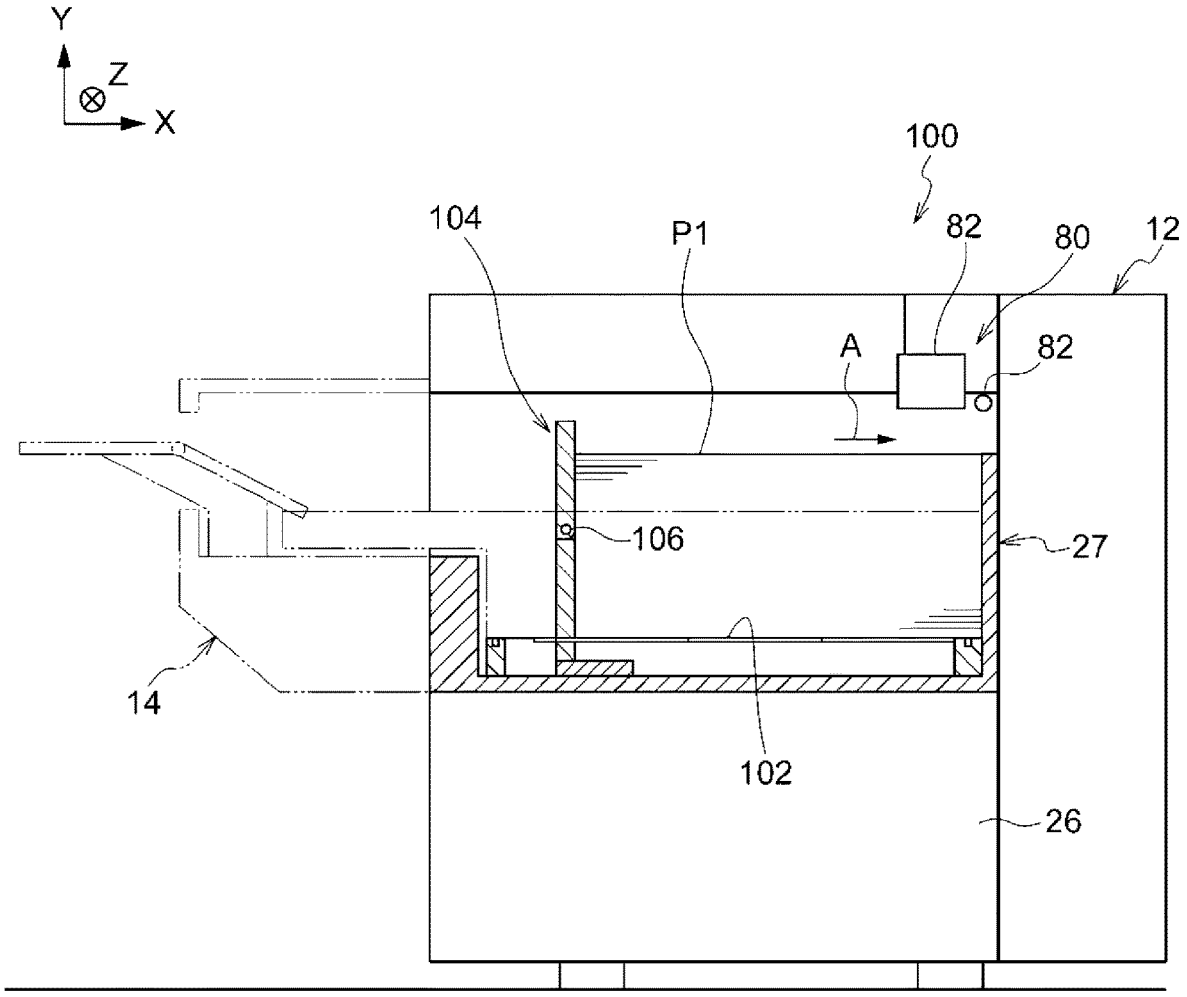
FIG. 14 is a cross-sectional view of a sheet feeding device according to a second exemplary embodiment.

As shown in FIG. 14, the sheet feeding device 100 has a configuration in which the accommodating device 14, which is an option, in the sheet feeding device 10 according to the first exemplary embodiment is removed. When the accommodating device 14 is removed, in the sheet feeding device 100, a lock mechanism of a pulling-out tray 27 disposed above the pulling-out tray 26 is released, and the pulling-out tray 27 can be pulled out.

A loading portion 102 on which the recording media P1 having a first size are loaded is provided inside the pulling-out tray 27. The loading portion 102 is provided with an end guide 104 that guides an upstream end portion (that is, trailing end portion), in a transport direction, of the recording media P1 having the first size. The end guide 104 includes a hinge portion 106 at an intermediate portion in the upper and lower direction. The hinge portion 106 can bend an upper piece 104A of the end guide 104 toward a downstream side in the transport direction of the recording medium P1. Although not shown, when the accommodating device 14, which is an option, is attached to the sheet feeding device 100, the upper piece 104A of the end guide 104 is bent toward the downstream side (that is, a loading portion 102 side) in the transport direction of the recording medium P1.

A length of the recording medium P1 having the first size in the transport direction (an arrow A direction) is, for example, equal to or more than a length of an A4 size in a shorter direction and equal to or less than a length of an A3 size in a longer direction. The length of the recording medium P1 having the first size in a direction orthogonal to the transport direction is, for example, equal to or more than the length of the A4 size in the shorter direction and equal to or less than the length of the A4 size in the longer direction.

In the sheet feeding device 100, when the recording media P2 having the second size smaller than the recording media P1 having the first size are loaded on the loading portion 102, the guide portion 60 is detachably attached to the contact portion 40 in a similar manner as the sheet feeding device 10 according to the first exemplary embodiment. Configurations of the contact portion 40 and the guide portion 60, and other configurations of the sheet feeding device 100 are similar to those of the sheet feeding device 10 according to the first exemplary embodiment.

In the above-mentioned sheet feeding device 100, similar operations and effects are obtained with a configuration similar to the sheet feeding device 10 according to the first exemplary embodiment.

Supplementary Description

In the first and second exemplary embodiments, the contact portion 40 includes the first blowing portion 44 and the second blowing portion 46. It is noted that the present disclosure is not limited to this configuration. For example, the number of at least one of the first blowing portion 44 or the second blowing portion 46 may be increased. The second blowing portion 46 may not be provided.

In the first and second exemplary embodiments, a configuration of the guide portion 60 may be changed without departing from the scope of the present disclosure. For example, a shape of the cylindrical portion 66B of the duct 66 may be changed, and may have a uniform cross-sectional area along an air flow direction. An attachment structure of the guide portion 60 to the contact portion 40 may be changed. The closing portion 68 may be a separate member from the guide portion 60. The closing portion 68 may not be provided.

In the first and second exemplary embodiments, a configuration of the shutter portion 74 may be changed without departing from the scope of the present disclosure. For example, the number of the bar portion 74D may be increased.

In the first and second exemplary embodiments, the shutter portion 74 is provided in the guide portion 60. It is noted that the present disclosure is not limited to this configuration. The shutter portion may not be provided.

While the present disclosure has been described in detail with reference to specific exemplary embodiments, it will be apparent to those skilled in the art that various other exemplary embodiments are possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A supply device comprising:

a loading portion on which recording media are loaded;

a transport unit configured to transport the recording media loaded on the loading portion;

a contact portion provided on the loading portion, the contact portion being in contact with a side end portion of the recording media having a first size in a direction intersecting with a transport direction, the contact portion having a blowing portion configured to blow air to the side end portion;

a guide portion detachably attached to the contact portion when recording media having a second size smaller than the recording media having the first size are loaded, the guide portion being configured to guide a side end portion of the recording media having the second size; and a duct provided in the guide portion, the duct comprising a discharge port configured to blow the air from the blowing portion to an upper end portion of the recording media having the second size and loaded on the loading portion, wherein the duct further includes an upper inclined portion at an upper portion in an upper and lower direction, the upper inclined portion being continuously linearly inclined downward to the discharge port, wherein:

the guide portion is provided with a shutter portion supported so as to be movable in the upper and lower direction, the shutter portion being configured to change an area of the discharge port according to a position of an uppermost surface of the recording media having the second size and loaded on the loading portion, the shutter portion comprises a pawl riding on the uppermost surface of the recording media having the second size and loaded on the loading portion, and the pawl is moved depending on the position of the uppermost surface of the recording media having the second size, and the shutter portion is moved in the upper and lower direction.

2. A supply device comprising:

a loading portion on which recording media are loaded;

a transport unit configured to transport the recording media loaded on the loading portion;

a contact portion provided on the loading portion, the contact portion being in contact with a side end portion of the recording media having a first size in a direction intersecting with a transport direction, the contact portion having a blowing portion configured to blow air to the side end portion;

a guide portion detachably attached to the contact portion when recording media having a second size smaller than the recording media having the first size are loaded, the guide portion being configured to guide a side end portion of the recording media having the second size; and a duct provided in the guide portion, the duct comprising a discharge port configured to blow the air from the blowing portion to an upper end portion of the recording media having the second size and loaded on the loading portion, wherein the guide portion is provided with a shutter portion supported so as to be movable in an upper and lower direction, the shutter portion being configured to change an area of the discharge port according to a position of an uppermost surface of the recording media having the second size and loaded on the loading portion, the shutter portion comprises a pawl riding on the uppermost surface of the recording media having the second size and loaded on the loading portion, and the pawl is moved depending on the position of the uppermost surface of the recording media having the second size, and the shutter portion is moved in the upper and lower direction.

3. The supply device according to claim 2, wherein the duct has a shape in which a cross-sectional area gradually decreases toward the discharge port.

4. The supply device according to claim 3, wherein the duct comprises a lower inclined portion at a lower portion in the upper and lower direction, the lower inclined portion being inclined upward toward the discharge port.

5. The supply device according to claim 2, wherein the contact portion comprises another blowing portion configured to blow air to an upper side end portion of the recording media having the first size in a state where the recording media having the first size is loaded on the loading portion, and the guide portion comprises a closing portion configured to close the other blowing portion in a state of being attached to the contact portion.

6. The supply device according to claim 3, wherein the contact portion comprises another blowing portion configured to blow air to an upper side end portion of the recording media having the first size in a state where the recording media having the first size is loaded on the loading portion, and the guide portion comprises a closing portion configured to close the other blowing portion in a state of being attached to the contact portion.

7. The supply device according to claim 4, wherein the contact portion comprises another blowing portion configured to blow air to an upper side end portion of the recording media having the first size in a state where the recording media having the first size is loaded on the loading portion, and the guide portion comprises a closing portion configured to close the other blowing portion in a state of being attached to the contact portion.

8. The supply device according to claim 5, wherein the blowing portion is disposed downstream of the other blowing portion in the transport direction of the recording media.

9. The supply device according to claim 6, wherein the blowing portion is disposed downstream of the other blowing portion in the transport direction of the recording media.

10. The supply device according to claim 7, wherein the blowing portion is disposed downstream of the other blowing portion in the transport direction of the recording media.

11. The supply device according to claim 2, wherein the shutter portion is provided with a bar portion configured to close a lower side of the discharge port in the upper and lower direction when moved upward according to the position of the uppermost surface of the recording media having the second size and loaded on the loading portion.

12. The supply device according to claim 2, wherein the transport unit comprises a transport roller configured to transport the recording media having the second size and loaded on the loading portion on an uppermost surface.

13. The supply device according to claim 12, wherein the transport unit comprises a suction unit configured to suction the recording media having the second size and loaded on the loading portion on the uppermost surface from above.

14. An image forming apparatus comprising:

the supply device according to claim 2, wherein the recording media are transported from the supply device to an image forming unit.

* * * * *